US006210174B1

(12) United States Patent
Pei et al.

(10) Patent No.: US 6,210,174 B1
(45) Date of Patent: Apr. 3, 2001

(54) ELECTRICAL CONNECTION ASSEMBLY

(75) Inventors: Wen-Chun Pei, Taipei; Yao-Chi Huang, Yung-Ho, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/337,981

(22) Filed: Jun. 22, 1999

(30) Foreign Application Priority Data

Dec. 23, 1998 (TW) ..... 87221336

(51) Int. Cl.[7] ..... H01R 12/00
(52) U.S. Cl. ..... 439/67; 439/498
(58) Field of Search ..... 439/69, 79, 80, 439/492, 494, 498, 499

(56) References Cited

U.S. PATENT DOCUMENTS 5,769,645 * 6/1998 Martin et al. ..... 439/79
5,876,222 * 3/1999 Gardner et al. ..... 439/79
5,954,522 * 9/1999 Ho et al. ..... 439/79

* cited by examiner

*Primary Examiner*—Tulsidas Patel
(74) *Attorney, Agent, or Firm*—Wei Te Chung

(57) ABSTRACT

An electrical connection assembly includes a connector having a first portion defining a first row of contact receiving channels receiving and retaining first contacts therein and a second portion defining second and third rows of contact receiving channels receiving and retaining second and third contacts therein. Each contact has a soldering section extending beyond the connector. A first flexible circuit board and a second flexible circuit board are connected to the connector. The soldering sections of the first contacts are soldered to the first flexible circuit board by means of either through hole or surface mounting techniques. The soldering sections of the second and third contacts are respectively soldered to the second flexible circuit board by means of through hole and surface mounting techniques.

9 Claims, 5 Drawing Sheets

ELECTRICAL CONNECTION ASSEMBLY

BACKGROUND OF THE INVENTION

1. Field of the Invention

The present invention generally relates to an electrical connector, and in particular to an electrical connection assembly comprising a connector soldered to two or more flexible circuit boards.

2. The Prior Art

Flexible circuit boards are frequently used in electrical devices having a very limited and complicated internal space, especially small-sized computers. The flexible circuit board is frequently equipped with an electrical connector for connection with other devices/parts. Conventionally, the flexible circuit board is secured to the connector by means of mechanical pressure applied thereon. FIGS. 1A and 1B of the attached drawings show a conventional connector, disclosed in Taiwan Patent Application Nos. 83102251, mounted to a flexible circuit board. The connector 2 comprises a pressurizing member 23 pivotally attached thereto by means of a trunnion 221. The pressurizing member 23 has a contour 231 which, when rotated, exerts a gradually-increasing force on the flexible circuit board 1 thereby securely retaining the flexible circuit board 1 on contacts 22 of the connector 2 thereby establishing firm electrical connection therebetween.

Such a conventional assembly procedure is only suitable for connecting a single flexible circuit board to the connector. Current trends of the electronic industry increasingly require the mounting of two or more flexible circuit boards to a connector. It is therefore desired to provide an electrical connection assembly that is capable of connecting two or more flexible circuit boards to a connector.

SUMMARY OF THE INVENTION

Accordingly, an object of the present invention is to provide an electrical connection assembly for connecting two or more flexible circuit boards to an electrical connector.

Another object of the present invention is to provide an electrical connection assembly for connecting flexible circuit boards to an electrical connector by means of soldering with the soldering points exposed outside the connector for facilitating inspection.

To achieve the above objects, an electrical connection assembly in accordance with the present invention comprises a connector having a first portion defining a first row of contact receiving channels receiving and retaining first contacts therein and a second portion defining second and third rows of contact receiving channels receiving and retaining second and third contacts therein. Each contact has a soldering section extending beyond the connector. A first flexible circuit board and a second flexible circuit board are connected to the connector. The soldering sections of the first contacts are soldered to the first flexible circuit board by means of either through hole or surface mounting techniques. The soldering sections of the second and third contacts are respectively soldered to the second flexible circuit board by means of through hole and surface mounting techniques.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 4A:
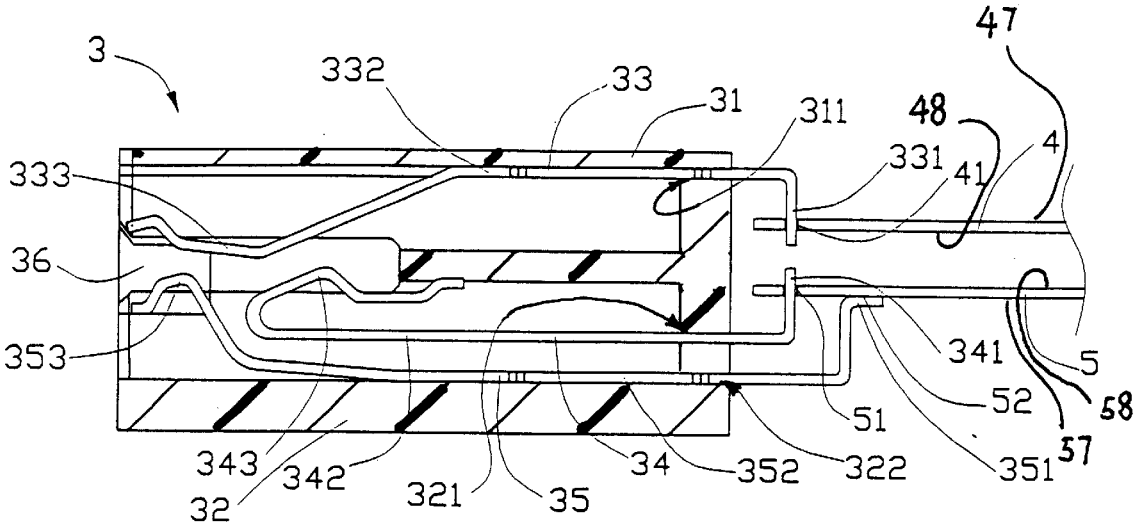
FIG. 4A is a cross-sectional view of the first embodiment of an electrical connection assembly.

Referring to the drawings and in particular to FIG. 4A, an electrical connection assembly in accordance with a first embodiment of the present invention comprises a connector 3, a first flexible circuit board 4, and a second flexible circuit board 5. The connector 3 defines a receiving slot 36 in a first face thereof for receiving a mating connector or other devices (not shown). The connector 3 comprises an upper portion 31 and a lower portion 32 in which three rows of contacts 33, 34, 35 are retained and extend beyond a second face of the connector 3 for electrical connection with the flexible circuit boards 4, 5. Understandably, those contacts may be arranged to function as signal, power or grounding contacts.

Figure 1A:
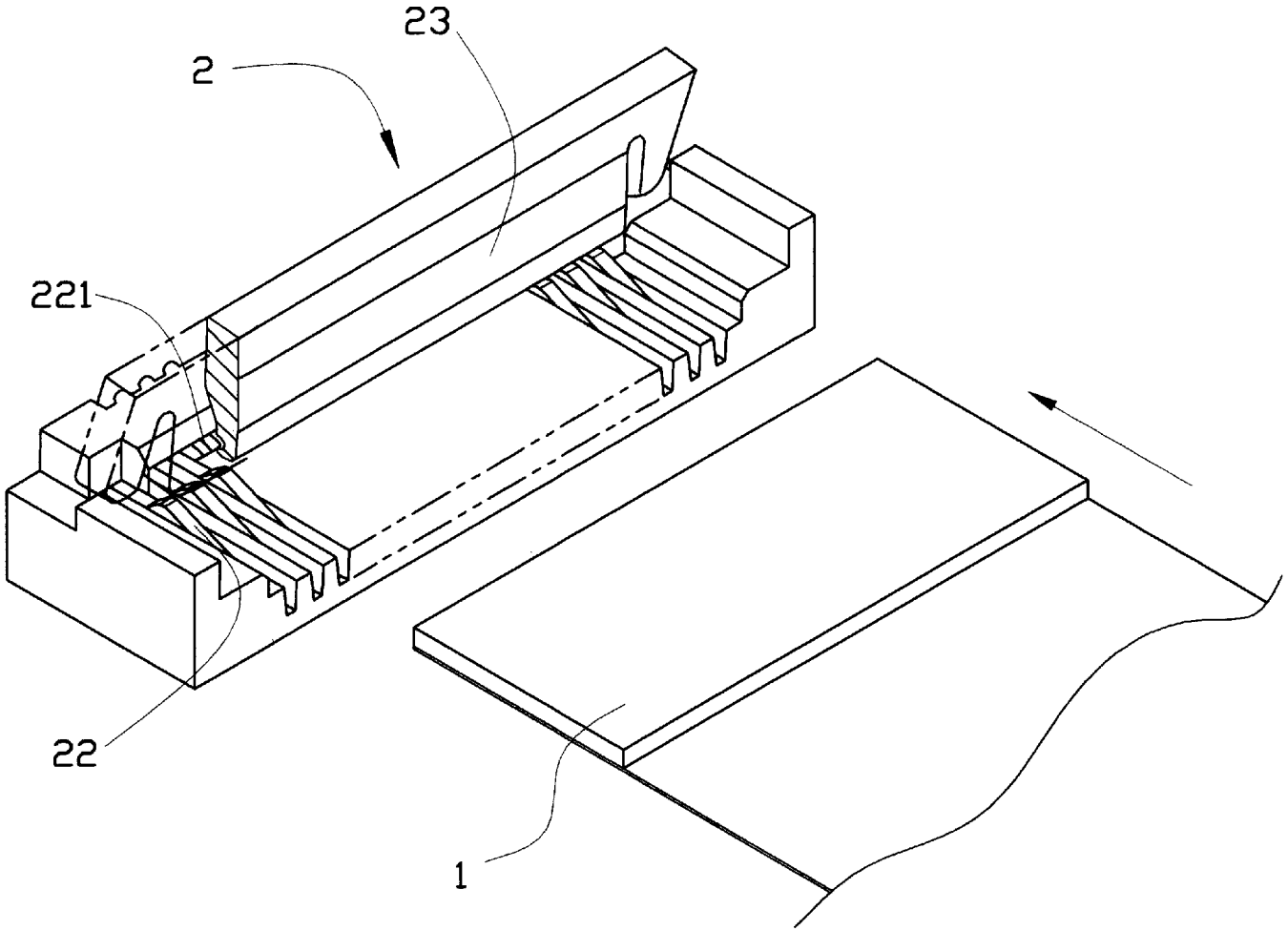
FIG.1A PRIOR ART
FIG. 1A is a perspective view of a conventional electrical connector to which a flexible circuit board is mounted.
Figure 1B:
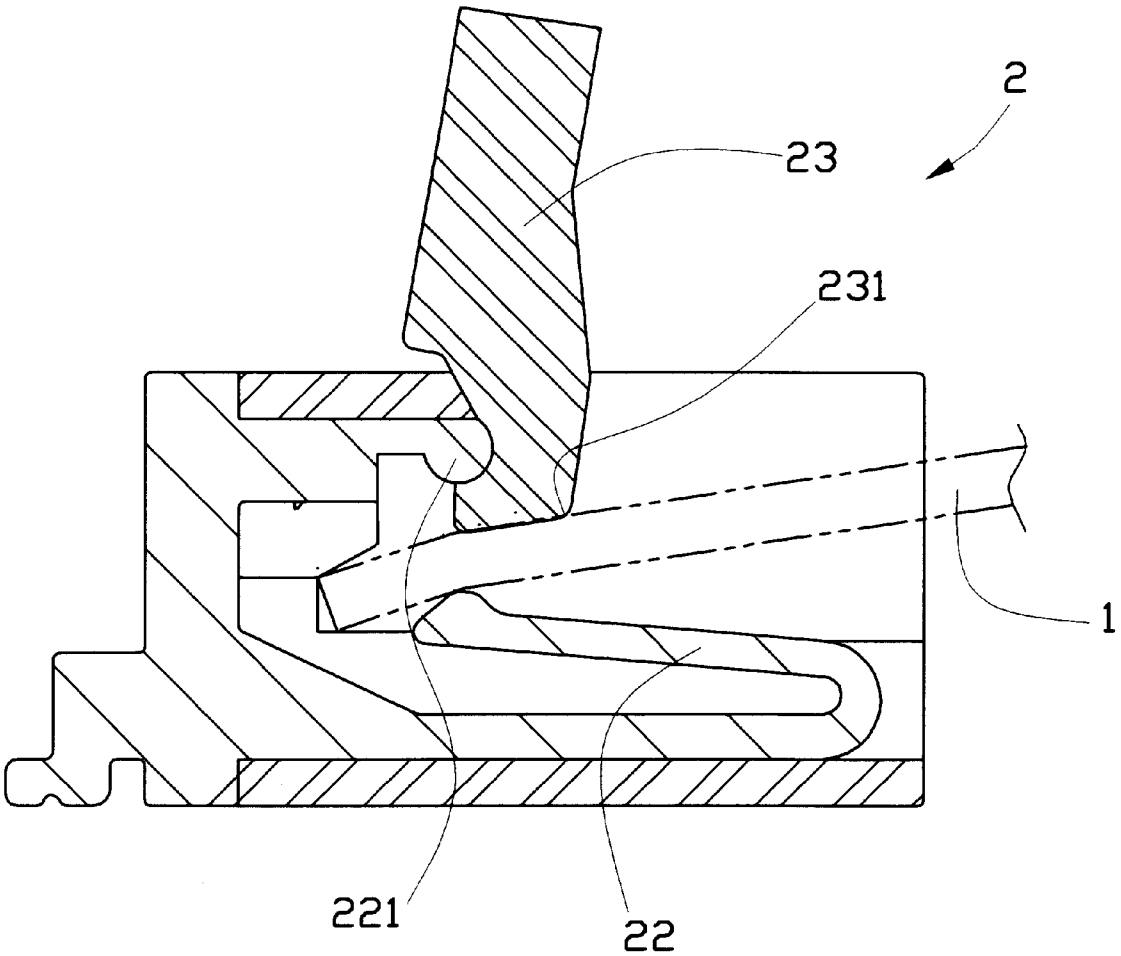
FIG.1B PRIOR ART
FIG. 1B is a cross-sectional view of the conventional connector of FIG. 1A.
Figure 2A:
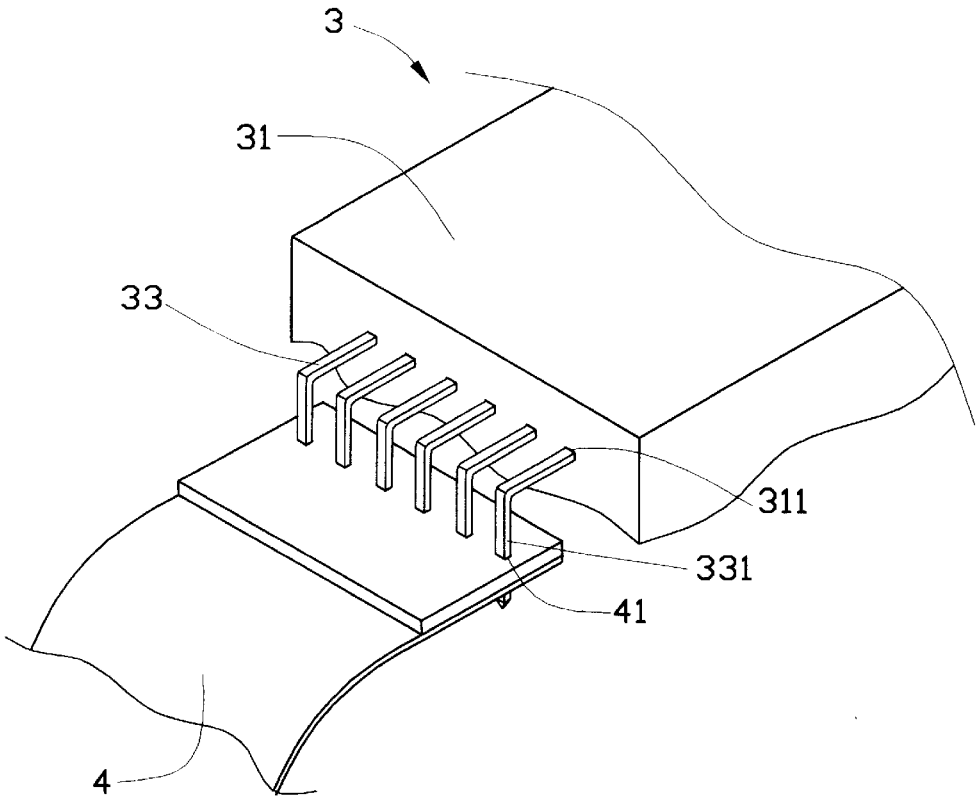
FIG. 2A is a schematic view showing a single row of contacts of an electrical connector in accordance with a first embodiment of the present invention connected to a flexible circuit board by means of soldering.
Figure 3:
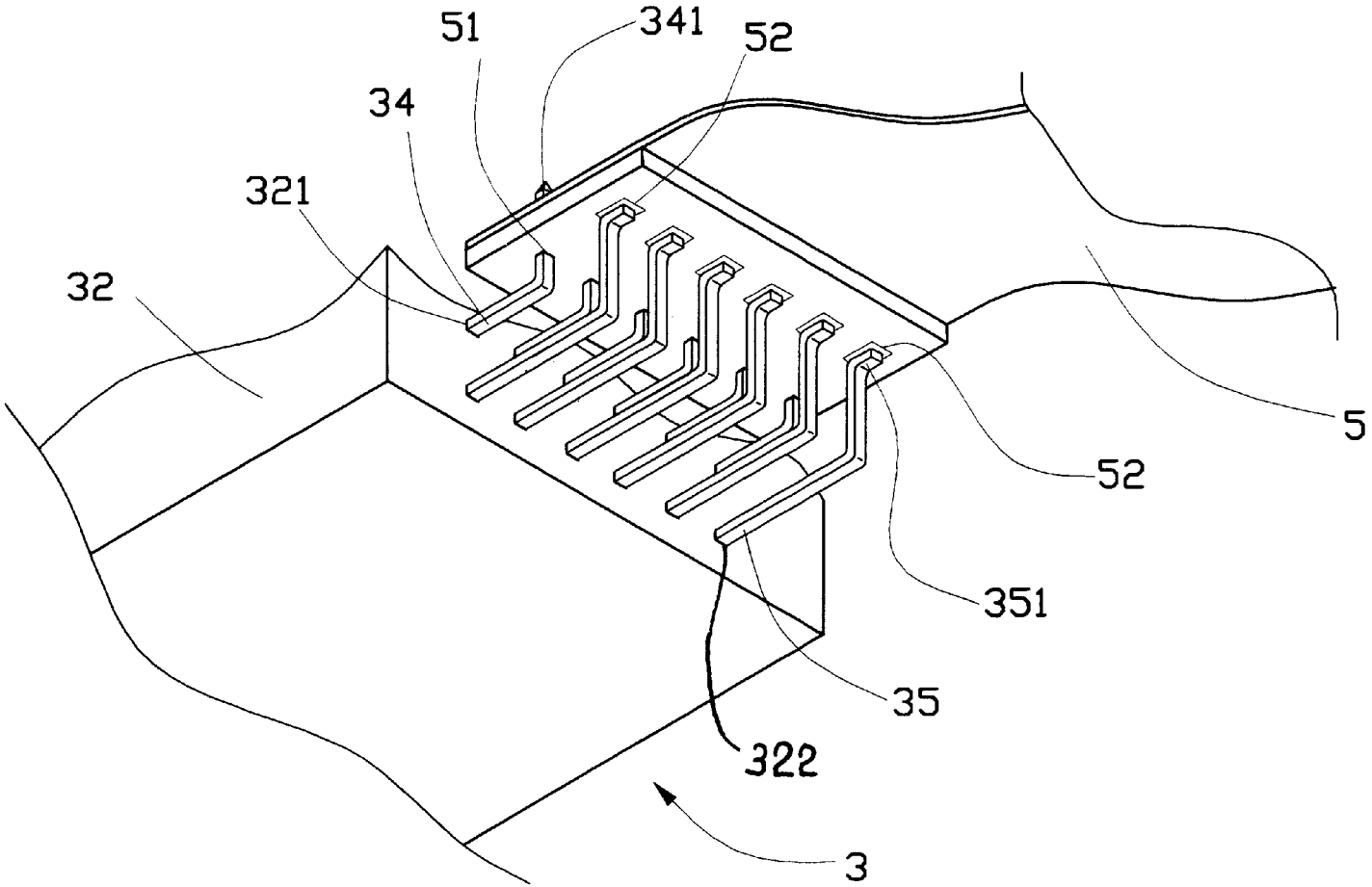
FIG. 3 is a schematic view showing two rows of contacts of the electrical connector of the first embodiment connected to a flexible circuit board by means of soldering.
Figure 4B:
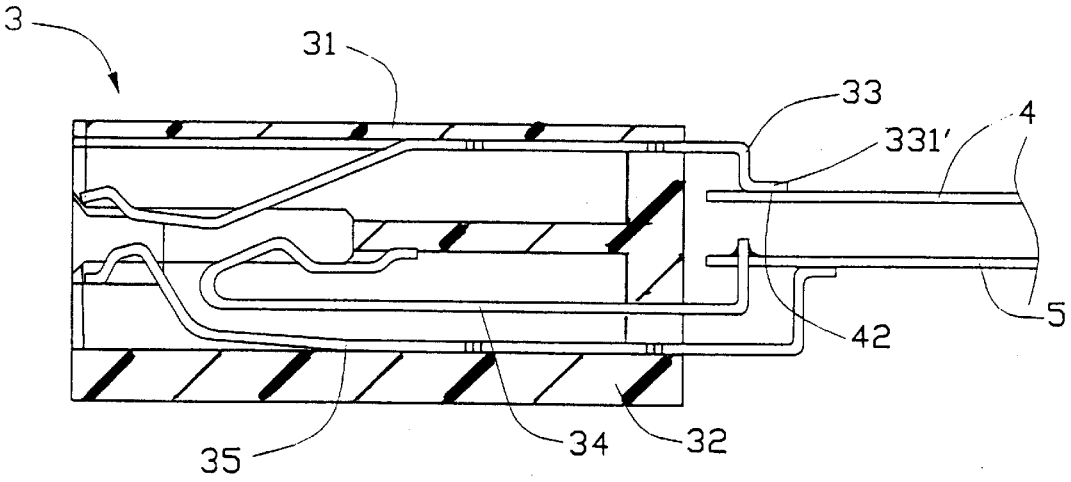
FIG. 4B is a cross-sectional view of the second embodiment of an electrical connection assembly.

Also referring to FIGS. 2A and 3, the upper portion 31 of the connector 3 defines a first row of contact receiving channels 311 for receiving and retaining the first contacts 33 therein. The lower portion 32 of the connector 3 defines second and third rows of contact receiving channels 321, 322 for respectively receiving and retaining the second and third contacts 34, 35 therein while the upper portions of these two channels shares the same space with each other. In other words, the pair of second contact 34 and corresponding third contact 35 are commonly received within the same space in the lower portion 32 (FIGS. 4A and 4B). The contacts 33, 34, 35 comprise soldering sections 331, 341, 351 extending beyond the second face of the connector 3, engaging sections 333, 343, 353 for electrically engaging with the mating connector, and intermediate sections 332, 342, 352 fixed in the connector 3 between the soldering sections 331,341, 351 and the engaging sections 333, 343, 353.

As shown in FIGS. 2A and 4A, the soldering section 331 of each first contact 33 forms a right angle and is substantially normal to the first flexible circuit board 4. Through holes 41 are formed in the flexible circuit board 4 in which the soldering sections 331 are received. Soldering is then performed to fix the soldering sections 331 of the first contacts 33 to the first flexible circuit board 4.

Referring to FIGS. 3 and 4A, the soldering section 341 of each second contact 34 forms a right angle and is substantially normal to the second flexible circuit board 4. The soldering sections 341 of the second contacts 34 extend through holes 51 formed in the second flexible circuit board 5 and are soldered thereto. The soldering section 351 of each third contact 35 forms two consecutive right angles thereby being offset therefrom in a parallel plane. The soldering sections 351 are engaged with conductive pads 52 formed on the second flexible circuit board 5 and surface mounted thereto.

Fixing the flexible circuit boards 4, 5 to the connector 3 by means of soldering eliminates the possibility of damaging the flexible circuit boards 4, 5 due to mechanical pressure and allows two or more flexible circuit boards to be simultaneously fixed to a connector. Furthermore, the soldering points are located outside the connector 3 thereby facilitating inspection and ensuring quality of the connection assembly.

Figure 2B:
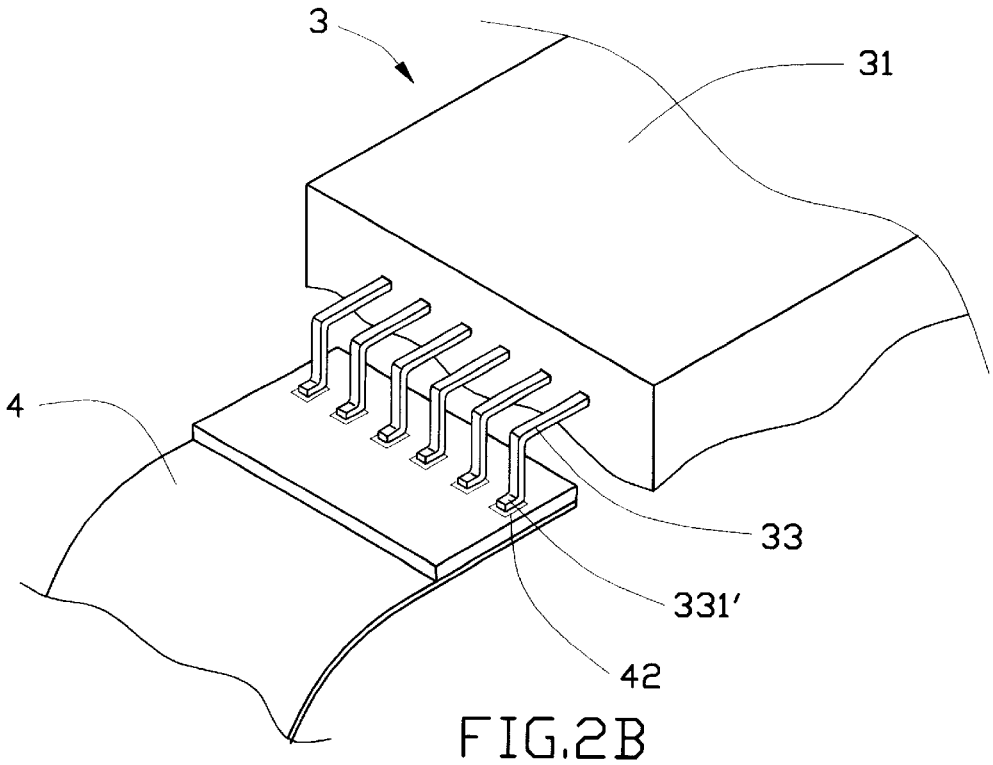
FIG. 2B is a schematic view showing a single row of contacts of an electrical connector in accordance with a second embodiment of the present invention connected to a flexible circuit board by means of soldering.

FIGS. 2B and 4B show a second embodiment of the present invention wherein the first contacts 33 are surface mounted to the first flexible circuit board 4. The soldering section 331' of each first contact 33 forms two consecutive right angles and is thus offset therefrom in a parallel plane. The soldering sections 331' are positioned on and surface mounted to conductive pads 42 formed on the flexible circuit board 4.

The feature of the invention is to provide two first and second flexible circuit board respectively connecting to the contacts 33, 34, 35 of the upper portion 31 and of the lower portion 32 in the connector 3. Additionally, the contacts of the lower portion further includes two type contacts 34, 35, and thus the second flexible circuit board 5 provides two connection regions wherein the inner one, which is close to the connector 3, is arranged to receive the through hole type second contacts 34 which is close to the center line of the connector, while the outer one is arranged to receive the surface mount type third contacts 35 which is close to the side wall of the connector.

It is also noted that each flexible circuit boards 4 and 5 includes an outward surface 47, 57 and an inward surface 48, 58 (FIG. 4A) wherein the inward surfaces 48, 58 of the boards 4 and 5 are facing to each other. The flexible circuit boards 4 and 5 are positioned parallel to each other, with a proper spatial relationship for not interfering with each other, at the back of the connector 3 close to the center line thereof, and the tail sections of the contacts 33, 34 (35) are arranged to extend in opposite directions and respectively approach the outward surfaces 47, 57 of the corresponding flexible circuit board 4, 5 from an exterior. With this arrangement, it is easy to correctly and reliably assemble the connector 3 and the corresponding flexible circuit board 4, 5 under sufficient inspection.

Although the present invention has been described with reference to the preferred embodiments, it is apparent to those skilled in the art that a variety of modifications and changes may be made without departing from the scope of the present invention which is intended to be defined by the appended claims.

What is claimed is:

1. An electrical connection assembly comprising:

a connector housing comprising at least a first portion defining at least one first row of contact receiving channels receiving and retaining first contacts therein and a second portion defining at least one second row of contact receiving channels receiving and retaining second contacts therein, each contact having a soldering section extending beyond the connector;

at least one first flexible circuit board and one second flexible circuit board, the soldering sections of the first contacts being soldered to the first flexible circuit board and the soldering sections of the second contacts being soldered to the second flexible circuit board, the soldering sections of the first contacts extending towards the soldering sections of the second contacts.

2. The electrical connection assembly as claimed in claim 1, wherein the flexible circuit boards define through holes through which the soldering sections of the corresponding contacts extend for being soldered thereto.

3. The electrical connection assembly as claimed in claim 1, wherein the flexible circuit boards form conductive pads thereon to which the soldering sections of the corresponding contacts are surface mounted.

4. The electrical connection assembly as claimed in claim 1, wherein the second portion defines second and third rows of contact receiving channels for receiving and retaining second and third contacts therein, each contact having a soldering section extending beyond the connector housing, the second flexible circuit board defining through holes therein for receiving and soldering the soldering section of the second contacts thereto, the second flexible circuit board further forming conductive pads thereon to which the soldering sections of the third contacts are surface mounted.

5. The electrical connection assembly as claimed in claim 4, wherein the first flexible circuit board defines through holes for receiving and soldering the soldering sections of the first contacts thereto.

6. The electrical connection assembly as claimed in claim 4, wherein the first flexible circuit board forms conductive pads thereon to which the soldering ends of the first contacts are surface mounted.

7. The electrical connection assembly as claimed in claim 1, wherein each of said first and second flexible circuit boards defines an outward surface and an inward surface, said inward surface of the first flexible circuit board faces to said inward surface of the second flexible circuit board, and the soldering sections of the first contacts and the soldering sections of the second contacts extend in opposite directions and respectively approach the outward surfaces of the corresponding flexible circuit boards from an exterior.

8. An electrical connector assembly comprising:

a connector housing comprising a first portion and a second portion divided by a central slot;

a first row of contacts positioned in the first portion; and a second row of contacts and a third row of contacts positioned within the second portion opposite to said first row of contacts, said second row of contacts positioned between said first row of contacts and said third row of contacts; wherein tail portions of the second row of contacts and of the third row of the contacts extend toward tail portions of the first row of contacts, and soldering portions of the second row of contacts are of a pin type, and are offset in a front-to-back direction from soldering portions of the third row of contacts which are of a surface mount type, whereby soldering portions of both the second row of contacts and the third row of contacts can be commonly mounted to a flexible circuit board, wherein said soldering portions of the second row of contacts are closer to the connector housing than said soldering portions of the third row of contacts.

9. The assembly as claimed in claim 8, wherein the first row of contacts are soldered to another flexible circuit board in a spatial parallel relation with the flexible circuit board connected to the second row and third row of contacts.

* * * * *